US009192805B2

(12) United States Patent
Adkins et al.

(10) Patent No.: US 9,192,805 B2
(45) Date of Patent: Nov. 24, 2015

(54) EXERCISE APPARATUS SYSTEM

(71) Applicant: PI Partners, LLC, Corpus Christi, TX (US)

(72) Inventors: Charles Adkins, Corpus Christi, TX (US); Austin Anderson, Corpus Christi, TX (US); Mark Adame, Corpus Christi, TX (US)

(73) Assignee: PI PARTNERS, LLC, Corpus Christi, TX (US)

( * ) Notice: Subject to any disclaimer, the term of this patent is extended or adjusted under 35 U.S.C. 154(b) by 74 days.

(21) Appl. No.: 13/929,125

(22) Filed: Jun. 27, 2013

(65) Prior Publication Data

US 2015/0005140 A1 Jan. 1, 2015

(51) Int. Cl.
*A63B 21/00* (2006.01)

(52) U.S. Cl.
CPC ..... *A63B 21/14* (2013.01)

(58) Field of Classification Search
CPC ..... A63B 21/00
USPC ..... 482/148, 35, 23, 33, 38, 41
See application file for complete search history.

(56) References Cited

U.S. PATENT DOCUMENTS

| | | | | |
|---|---|---|---|---|
| 4,609,356 | A * | 9/1986 | Gilden et al. | 434/259 |
| 4,846,692 | A * | 7/1989 | Delcambre | 434/159 |
| 8,231,511 | B2 | 7/2012 | Dalcourt | |
| 2003/0038423 | A1 * | 2/2003 | Turner et al. | 273/157 R |
| 2012/0088639 | A1 | 4/2012 | Dalcourt | |

* cited by examiner

*Primary Examiner* — Jerome W Donnelly
(74) *Attorney, Agent, or Firm* — Denko Coburn Lauff LLP

(57) ABSTRACT

A versatile exercise apparatus and system is provided. A cylindrical apparatus having first and second surfaces of either planar or arcuate configuration is configured with plural polygonal openings useable for manipulation of the apparatus or as openings into which various modules may be set to increase the activity versatility of the apparatus. The provided exercise apparatus provides flexibility while economizing on occupied space.

11 Claims, 8 Drawing Sheets

EXERCISE APPARATUS SYSTEM

BACKGROUND

Maintaining a regular exercise regimen can be difficult. Even though away-from-home gyms typically have a large variety of exercise equipment, they are often inconvenient and can be overcrowded at the most desirable times. Exercising at home is typically more convenient but limited by equipment selection as well as cost. Further, many types of exercise equipment are single-purpose yet occupy considerable space. Consequently, what is needed is a versatile, convenient and compact exercise apparatus and system.

SUMMARY OF THE INVENTION

A versatile exercise apparatus and system is provided. A cylindrical apparatus having first and second surfaces of either planar or arcuate configuration is configured with plural polygonal openings useable for manipulation of the apparatus or as openings into which various modules may be set to increase the activity versatility of the apparatus. The provided exercise apparatus provides flexibility while economizing on occupied space.

DETAILED DESCRIPTION

Figure 1:
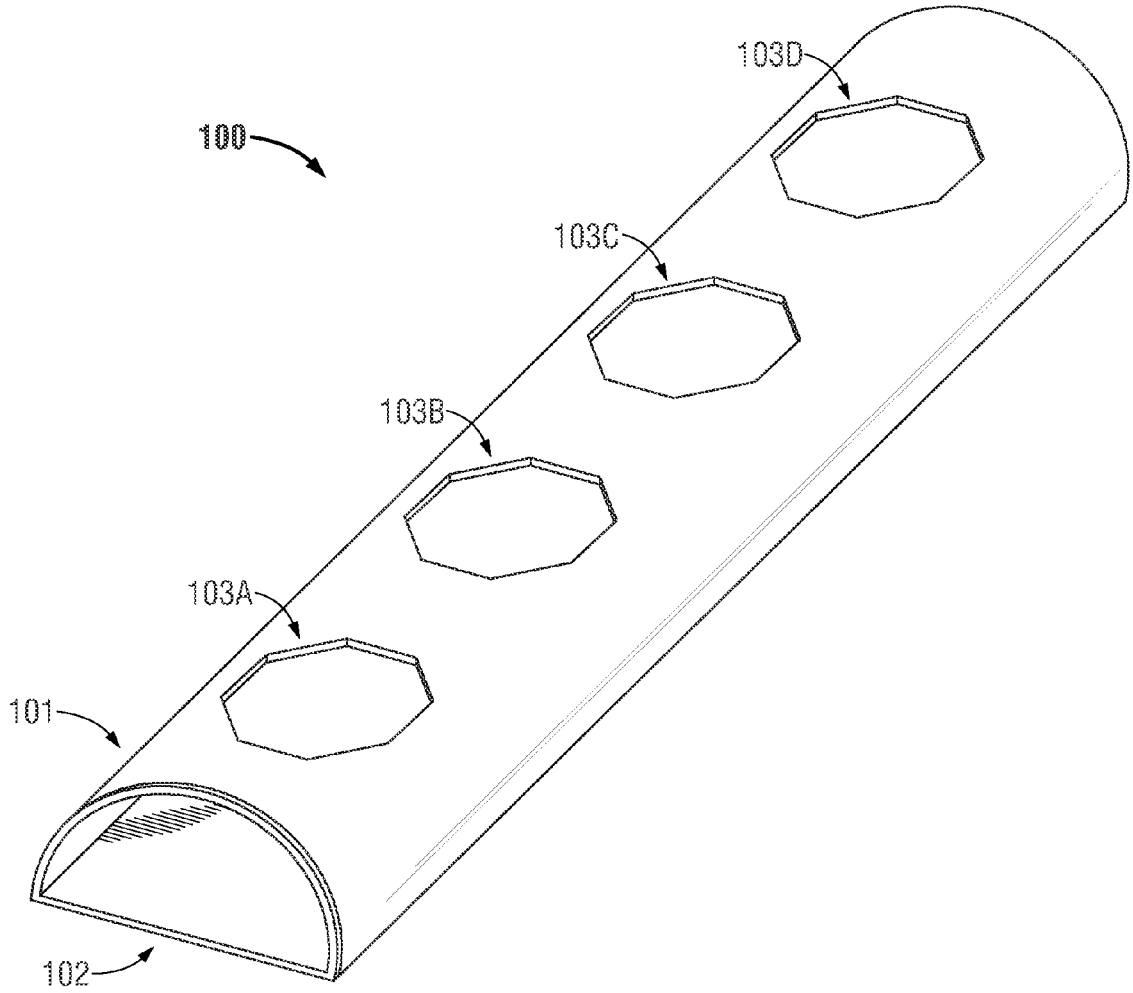
FIG. 1 depicts an embodiment of an exercise apparatus.

FIG. 1 depicts an embodiment of an exercise apparatus 100. Apparatus 100, as shown, is comprised of a hollow half-round cylinder. In this context, "cylinder" is being used in the mathematical sense meaning that it does not necessarily require a circular cross-section but exhibits an arcuate surface.

Figure 2A:
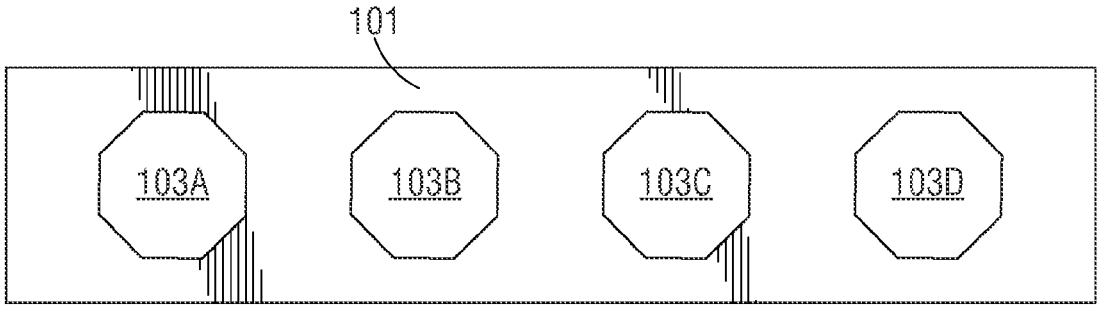
FIG. 2A depicts a plan view of an embodiment of an exercise apparatus.
Figure 2B:
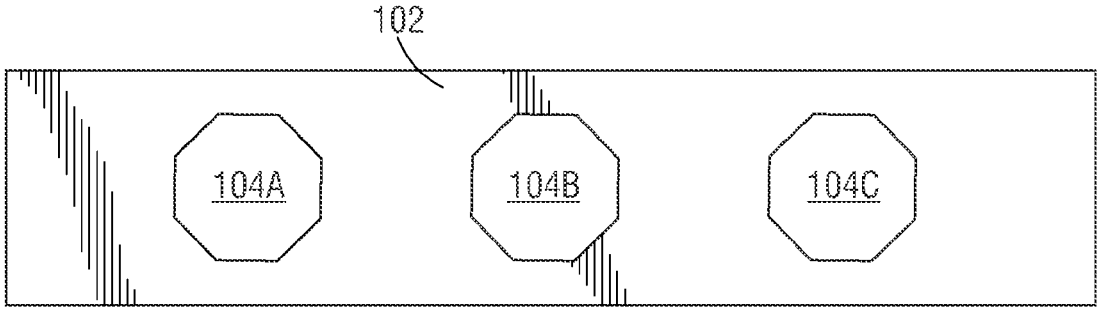
FIG. 2B depicts an opposing view of FIG. 2A.
Figure 2C:
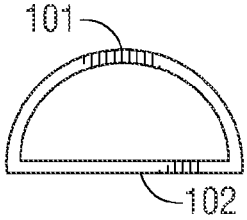
FIG. 2C depicts an exemplar cross-sectional view of an embodiment such as that depicted in FIG. 1.

Exercise apparatus 100 exhibits arcuate side 101 and a planar side 102 as further illustrated in FIGS. 2A, 2B, and 2C. FIGS. 2A and 2B illustrate opposing views of the exercise apparatus 100. FIG. 2A depicts a plan view of the arcuate side 101 of exercise apparatus 100. FIG. 2B depicts a plan view of planar side 102 of exercise apparatus 100. FIG. 2C depicts a cross-sectional view of the exercise apparatus embodiment 100. Arcuate side 101 exhibits a plurality of polygonal openings 103A-D. As shown, planar side 102 exhibits a plurality of octagonal openings 104A-C. Openings 103A-D and 104A-C are depicted as being octagons but those of skill in the art will understand after appreciating this disclosure that openings 103 as well as openings 104 may be any of a variety of polygonal configurations. Later in this disclosure use of apparatus 100 with modules 300 of various configurations will be disclosed and it should be appreciated that although apparatus 100 can be employed with any modules 300, the polygonal configurations of openings 103 and 104 are best configured for use with modules 300 of like configuration. Although in the depicted embodiment, openings 103 and 104 are the same size, openings 103 and 104 may be devised in a variety of sizes for use with a variety of module configurations.

Those of skill will appreciate that the term "side" is used in this disclosure with reference to the surfaces of the apparatus but it should be appreciated that the term side is used so that in later parts of this disclosure it is clear that the one or more modules optionally used with the apparatus 100 preferably project into the respective sides and are preferably affixed to their respective sides by use of attachment mechanisms preferably provided in pairs that straddle the side into which the modules is projected. Other embodiments could be devised in which the accessory modules such as that shown as 300 below are inserted into closed end cavities in the respective sides of apparatus 100 rather than through openings in the sides but such embodiments would require thick structural configurations and likely be substantially less convenient.

The configurations of the openings shown in FIGS. 1 and 2 are merely illustrative and it should be appreciated that other embodiments may utilize openings of various sizes and may include more or fewer openings on a particular side. Other embodiments may utilize openings 103 that are not the same size as the openings 104. For example, the outer openings 103A, 103D, 104A, and 104C may have one size, whereas inner openings 103B, 103C, and 104B may have a different size. Openings 103 and 104 are not limited to an octagonal shape, but the octagonal shape does provide a few advantages. An octagonal opening provides, for example, a comfortable grip for holding the exercise apparatus when used to perform various types of motion exercises.

The orientations of the polygonal openings on exercise apparatus 100 also provide benefits. Four sides of polygonal openings shown in FIG. 1 are parallel to the four planar sides of the exercise apparatus. This aids in attaching an elastic band between the side of opening 103A and nearest the edge of exercise apparatus 100. If replicated on the other side with opening 103D, an exerciser could stand on the exercise apparatus and pull the corresponding elastic bands on each side as part of a workout routine.

If the openings 103 are sufficiently large to accommodate the width of a foot, the openings can also be used as a foot hold. A user could stand across a pair of openings and then utilize elastic bands attached to both ends of the exercise apparatus 100. This allows an exerciser to keep the exercise apparatus in place while pulling elastic bands attached at the ends.

Exercise apparatus 100 is preferably comprised from a stiff material having a high Young's modulus, including for example, but not limited to plastic, steel, carbon fiber, titanium, wood, hard rubber, and combinations or composites of each. The exercise apparatus may be used to support the weight of an exerciser including any additional weight that he or she might be carrying. It preferably should also have sufficient stiffness to avoid deformation within the anticipated weight range. This is in contrast to elastomeric material having a low Young's modulus, such as elastic bands, soft rubber, and certain types of foam.

By placing the curved side on the ground, the exercise apparatus can be used for balance training. By placing his or her feet so as to span the short sides of exercise apparatus 100 (not necessarily with the use of openings 104), the exerciser could add a balancing aspect to an exercise routine. This routine could be modified by increasing or decreasing the distance between the two feet of the exerciser.

Some of the advantages of exercise apparatus 100 can be achieved even without the presence of planar side 102. For example, if planar side 102 were removed from the exercise apparatus 100 shown in FIG. 1, curved side 101 would still define a plane even though there would not be any material spanning this plane. This configuration would reduce the weight of exercise apparatus 100 and may provide for easier storage in environments that employ a plurality of these exercise apparatuses. For example, in a gym it might be desirable to stack many of the disclosed apparatuses to reduce storage space.

The placement and numerosity of the openings 103 and 104 can also be used to vary a workout routine. For example, assume that a user is positioned near the edge of exercise apparatus 100 that is nearest to 103A. Gripping 103A and swinging the opposite end upwards and downwards provides a certain amount of resistance. This resistance can be reduced for the same motion by grabbing 103B instead. This can be further reduced by grabbing 103C. The resistance could also be changed if the exerciser re-oriented the exercise apparatus 100 to be parallel to the shoulders. In this configuration, the exerciser could perform a curl-type motion using one or two hands as desired. By varying the grip and motion, a user can vary the difficulty of the exercise. The openings 103 and 104 can be placed so as to accommodate a variety of such exercises.

Figure 3:
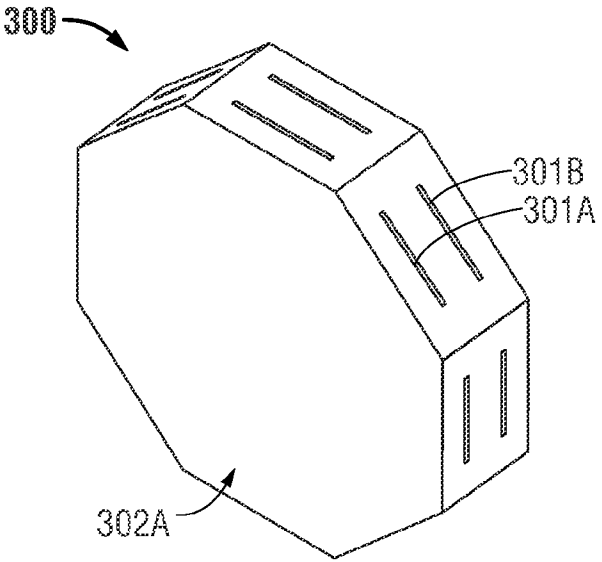
FIG. 3 depicts an exemplar embodiment of a module useable with embodiments of the exercise apparatus.

The utility of exercise apparatus 100 can be enhanced via the use of modules attached to apparatus 100. FIG. 3 depicts an example of an attachment module 300 that may be referred to simply as a module. The shape of the module shown in FIG. 3 corresponds to the openings 103 and 104 shown in FIG. 1. However, module 300 may have other shapes that correspond to different sized openings 103 and 104.

As shown in FIG. 3, module 300 is a regular octagonal right prism configured for attachment to the apparatus 100 through opening 103 or 104. Accordingly, the outer dimensions of module 300 are smaller than the inner dimensions of an opening 103 or 104. Along one or more of the edges of each module 300, there is at least one attachment mechanism typified by 301A and 301B examples of which are depicted in FIG. 4. Preferably, attachment mechanisms are configured in pairs as identified by references 301A and 301B in FIGS. 4A and 4B. Thus, one of the pair of attachment mechanisms 301 is disposed on one side of side 101 or 102 while the other of the pair is disposed on the other corresponding side of the respective side of apparatus 100. Some embodiments may be configured so that only a single attachment mechanism (rather than the pairs as shown) is used but such configurations would preferably, if at all, be employed when tension was applied to module 300 such as would be the case with the module depicted in FIG. 5A.

Attachment mechanisms may be configured in a variety of ways as those of skill will understand after appreciating this disclosure. In the depicted embodiment of FIG. 3, attachment mechanism 301 is comprised of one or more spring plungers that are spaced to approximate the thickness of arcuate side 101 or planer side 102. When engaged with one of attachment mechanisms 301 on one side of side 101 or 102 and the other attachment mechanism 301, attachment mechanism 301 will establish a secure but separable connection between module 300 and exercise apparatus 100. Module 300 also includes up to two faces 302A and 302B (not shown). These faces need not be planar or octagonal. In some embodiments, module 300 may be open on both sides thus providing a conduit to the interior of apparatus 100. In other embodiments, it may be closed on one or both sides. Depending on the application, module 300 may be hollow or could be filled with a dense material to add weight to the exercise apparatus 100 when attached.

Figure 4C:
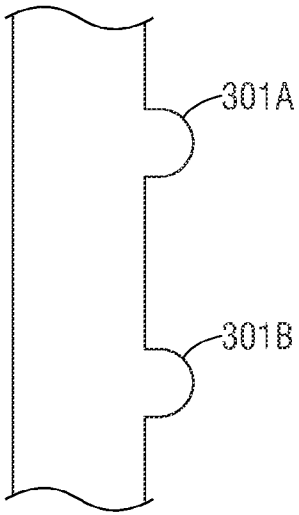
FIG. 4C depicts a module attachment mechanism comprising two exemplar ridges.
Figure 4B:
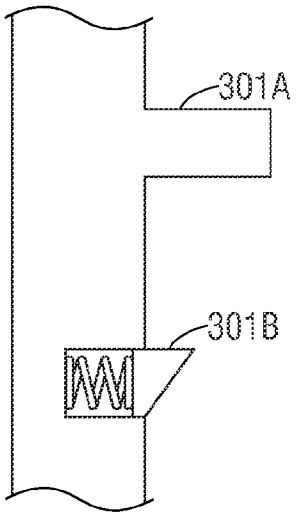
FIG. 4B depicts a module attachment mechanism comprising a spring plunger and an exemplar ridge.
Figure 4A:
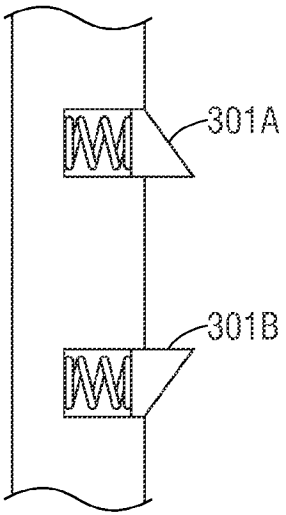
FIG. 4A depicts a module attachment mechanism comprising two spring plungers.
Figure 4D:
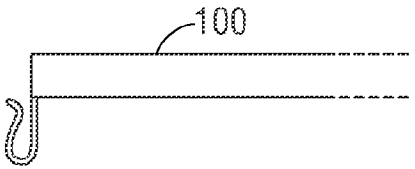
FIG. 4D depicts a module attachment mechanism comprising a spring clip.

The pair of spring plungers 301A and 301B illustrated in FIG. 3 is just one example of attachment mechanisms 301 that may be employed. FIG. 4A is a cross-sectional view of a pair of spring plungers that may be used as attachment mechanism 301. In an alternate embodiment, a single spring plunger paired with a ridge could be employed as illustrated in FIG. 4B. In some embodiments, a spring may be unnecessary and ridges can be used to hold a module 300 in place as illustrated in FIG. 4C. In an alternate embodiment, it may also be desirable to place the attachment mechanism within exercise apparatus 100 itself. FIG. 4D depicts a spring clip on apparatus 100 used to hold an inserted module 300 in place. When inserted, the spring clip may hold the module 300 in place purely through pressure or may employ ridges in the sides of a module 300.

An attachment mechanism 301 may not be the same for every side or at the same relative depth. For example, a module 300 attached to an opening 103 on arcuate side 101 would interface with the exercise apparatus at different relative depths. Accordingly, variable attachment mechanism depths would enable module 300 to attach to all exemplar eight sides simultaneously despite the curved aspect of the side. In another embodiment, module 300 may have multiple attachment mechanisms spaced along the depths of its sides to allow for a variety of installation depths. In addition to the sides of module 300, an attachment mechanism 301 could also be placed on one or more of the corners of module 300.

FIGS. 5A through 5I illustrate examples of modules 300 that could be used with the disclosed exercise apparatus 100 although those of skill will appreciate that in addition to those shown, many other modules may be employed with apparatus 100 to provide a versatile exercise system. The depths and relative sizes shown are purely for purposes of illustration. Individual modules may have different depths than what are illustrated and may include other features as well. Modules need not be used individually and can be combined in many configurations to provide versatility in exercise regimens and adaptability to different environments.

Figure 5A:
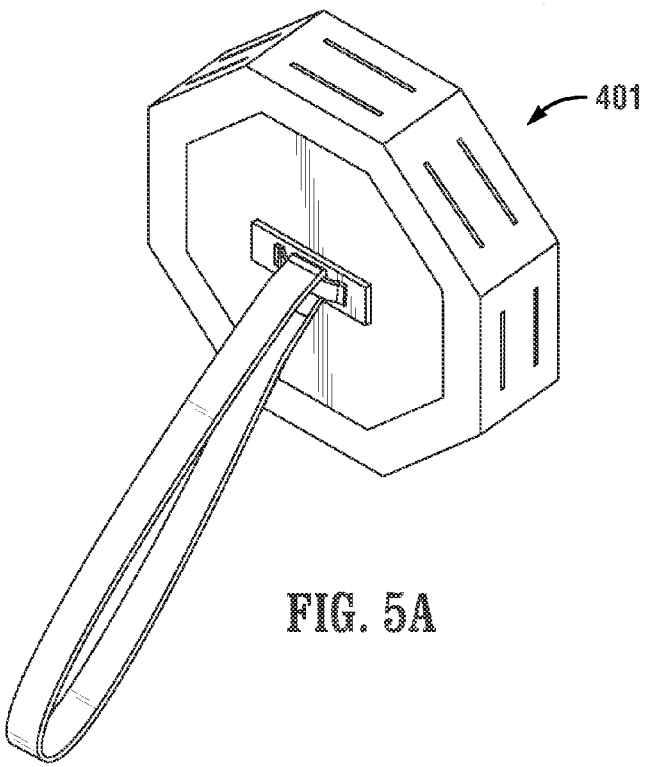
FIG. 5A depicts a module having an elastic band.

FIG. 5A depicts an elastic band module 401. Via a loop on module 401, a length of elastic material, such as rubber tuning or bungee cord can be attached to this module.

Figure 5B:
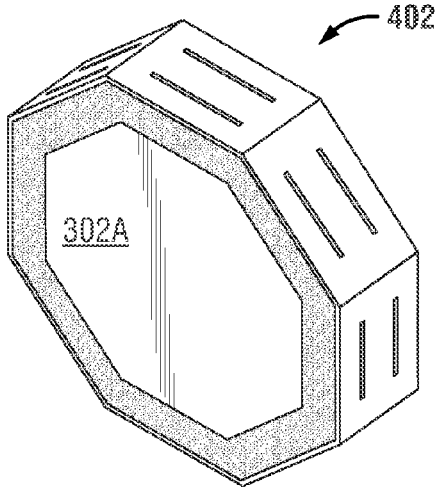
FIG. 5B depicts a module exhibiting a flat surface.

FIG. 5B depicts a flat surface module 402 that could be employed to prevent the exercise apparatus 100 from moving. If attached to planar surface 102, module 402 may prevent the exercise apparatus from sliding. If attached to arcuate surface 101, module 402 may prevent the exercise apparatus from rolling as well as sliding. Module 402 may include various surfaces on its face 302A. For example a non-slip pad might be used to prevent sliding when used on slick surfaces or Velcro might be used to prevent sliding on carpet.

Figure 5C:
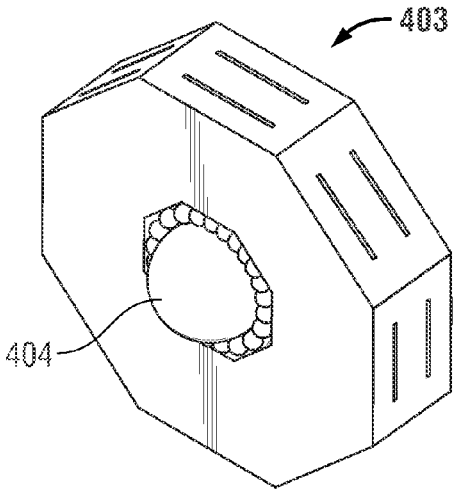
FIG. 5C depicts a module that includes a protruding rolling surface.

FIG. 5C depicts a rolling module 403. A module 403 might utilize one or more ball casters such as those identified by reference 404. It might also use wheels or other types of casters with or in lieu of ball casters. Various selections can be made based on the desired height, the anticipated rolling surface, the anticipated load, and the desired degrees of freedom in rolling. In some applications, it may be desirable to use wheels that roll along a single axis. In other applications, omnidirectional movement may be desired. In some applications, a flat-surface module 402 with a slick coating could be used in place of or in addition to a rolling module 403. In alternative uses of apparatus 100 and module 403 for example, rolling caster 404 could be used as a back massager.

Figure 5D:
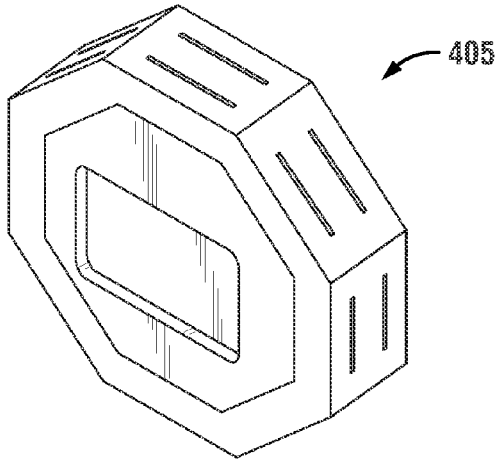
FIG. 5D depicts a media module.

FIG. 5D depicts a media attachment module 405. Module 405 is configured to receive a mobile electronic device, including but not limited to a cell phone or a media player. Module 405 may contain one or more attachment devices such as, for example, Velcro strips or elastic bands or confining ridges built into the module for holding a mobile electronic device in place. Of course, a module such as module 405 could be used to hold other objects in place.

Figure 5E:
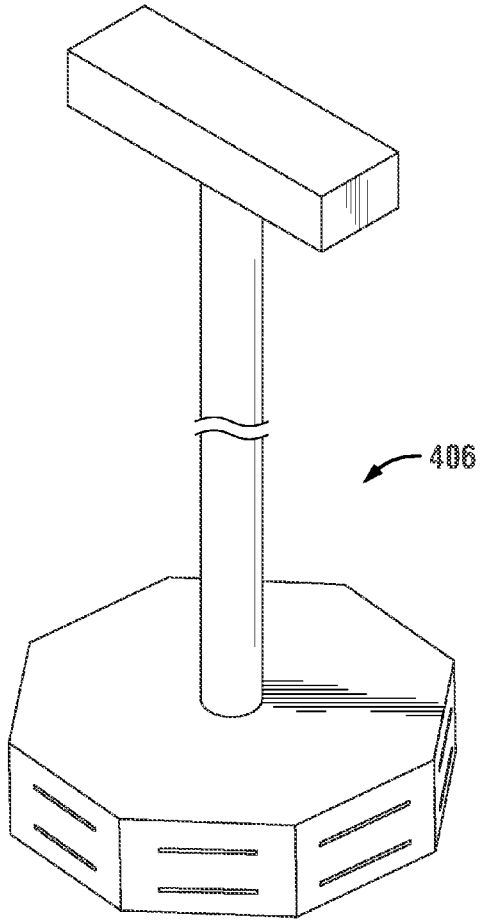
FIG. 5E depicts a riser module.

FIG. 5E depicts a riser module 406. Module 406 contains one or more legs that when installed in an exercise apparatus 100 can be used to lift at least a portion of exercise apparatus 100 above the ground. The precise nature of a riser module 406 will vary with the anticipated usage. In some configurations, only a single end of exercise apparatus may need to be elevated and a riser module 406 with two legs along the same plane may be useful. In other cases, a riser module 406 with three legs spread like a tripod might be useful. The specific type of riser module 406 may depend on the desired configuration, the location of use, the openings 103 and 104 utilized, and the anticipated load. In some embodiments, a plurality of riser modules may be used simultaneously.

Figure 5F:
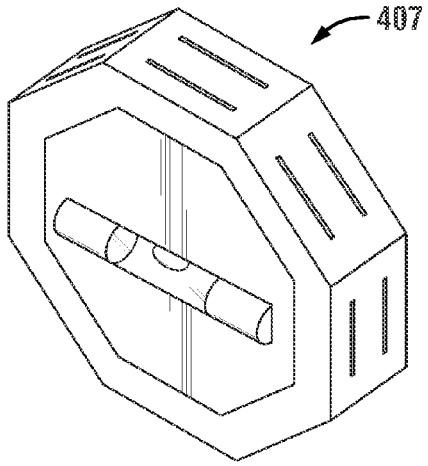
FIG. 5F depicts a bubble level module.

FIG. 5F depicts a bubble level module 407. Module 407 may contain one or more bubble levels, possibly in perpendicular axes. In certain applications, it may be desirable to determine the orientation of exercise apparatus 100. Also, when employing adjustable height riser modules, it may be necessary to insure that the exercise apparatus 100 provides a level surface.

Figure 5G:
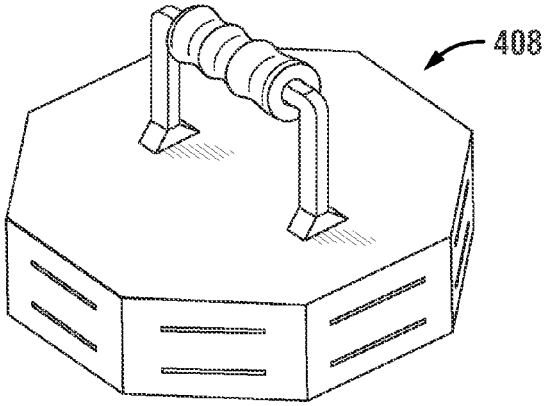
FIG. 5G depicts a handle module.

FIG. 5G depicts a handle module 408. Module 408 contains some type of handhold. In some configurations, the handhold may rise above one of the faces of a module 408. In other configurations, the handhold may be part of a cavity formed within a face of module 408. In some configurations, module 408 may simply have a bar spanning its diameter.

Figure 5H:
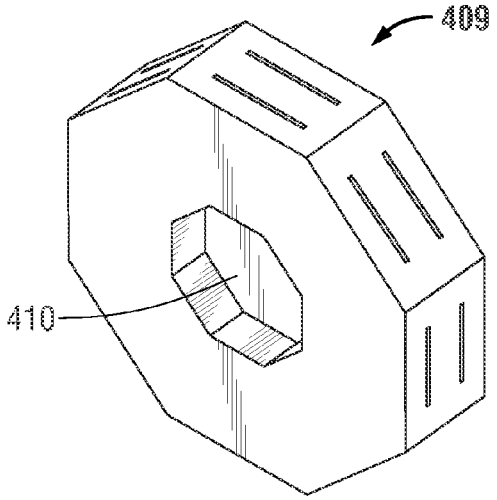
FIG. 5H depicts an adapter module.

FIG. 5H depicts an adapter module 409. It may be desirable to use a module configured for a smaller opening with an exercise apparatus possessing larger openings. Module 409 is thus configured to adapt the smaller module to the apparatus having larger openings by providing an opening 410 adapted for use with the smaller module.

Figure 5I:
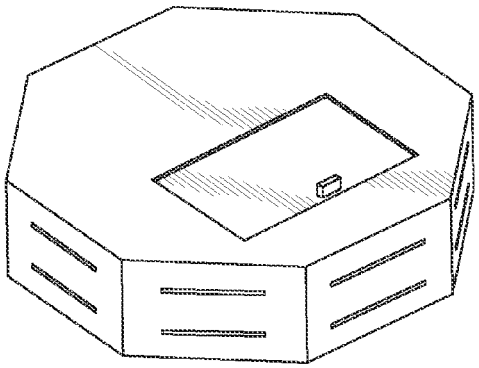
FIG. 5I depicts a weight module.

FIG. 5I depicts a weighting module 411. By adding weights to a module 411, the difficulty of a particular exercise regimen can be increased. The module 411 shown in FIG. 5I includes a sliding door that can be opened to allow weights to be placed within the module. In other embodiments, module 411 contains one or more spring clips for the attachment of weights. In other embodiments the face of the module 411 can be removed and reattached to allow for the insertion of weights. Weighting module 411 my itself provide the additional sought weight thus transforming apparatus 100 into a fixed weight structure for exercise with which a variety of standard exercises may be performed such the bench press and squats, for example.

Modules can be formed of any material sufficiently strong to fit securely enough within an opening 103 or 104 to serve its desired purpose. In some embodiments modules are formed from the same material as the exercise apparatus itself. Each side of a module 300 need not be comprised of the same material, and an individual side of a module 300 may be comprised of layers of different materials. For example, the sides of a module 300 may be comprised of a steel outer layer and a plastic inner layer. If present, faces 302A and 302B need not be comprised of the same materials as the individual sides.

The configuration and nature of the attachment mechanism may vary between modules as well. For example, a bubble level module 407 may experience little to no applied force when used. However, a riser module 406 may need to support the weight of exercise apparatus 100 plus several hundred pounds of additional weight. Accordingly, there may be differences in depth, material, and attachment mechanism configuration between various types of modules 300.

Exercise apparatus 100 and modules 300 can be manufactured using standard manufacturing processes. In one embodiment, exercise apparatus 100 is formed using a half-round tube that has been cut to form the desired length of the exercise apparatus. In a simple fabrication method, a standard machining process could be applied to create a plurality of uniformly-sized and uniformly-spaced openings are formed on opposing sides of the exercise apparatus 100 wherein the set of openings are centered along both planar axes. It is important to note however that each opening need not be coincident in configuration or size with other openings.

Although octagonal openings and modules are used in this disclosure as examples, the disclosed exercise apparatus could employ openings and attachments with a different number of sides and configurations. Altering the shape of the openings 103 and 104 will affect the suitability of exercise apparatus 100 for a given application but may provide greater flexibility in other applications. It may also be desirable to choose an opening shape based on aesthetic considerations as well.

Figure 6A:
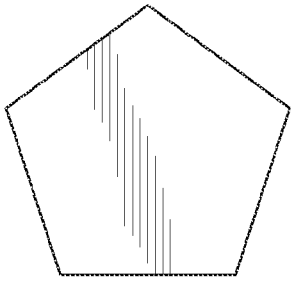
FIG. 6A-6G depicts exemplar alternative polygonal opening configurations useable in an embodiment.
Figure 6B:
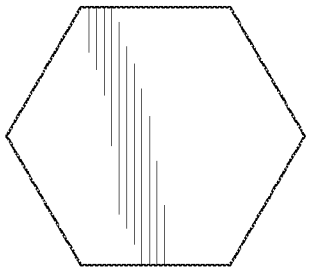
Figure 6C:
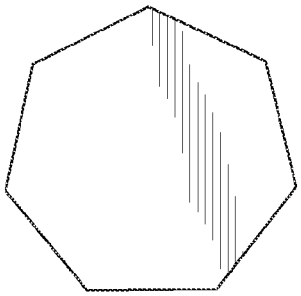

Octagonal openings provide eight unique, yet interchangeable, orientations that reasonably resist rotation from one orientation to another. However, openings with a different number of sides and/or an irregular configuration also provide many benefits. FIGS. 6A-6H depict just a few of many available alternate opening configurations that could be employed with the disclosed exercise apparatus 100. FIGS. 6A, 6B, and 6C illustrate a pentagon, hexagon, and a heptagon, respectively. If resistance to the rotation of an attached module is of particular concern, openings such as 6D, 6E, and 6F can be employed. The irregular shape prevents rotation, but may also reduce the permissible orientations of corresponding modules 300. Some of these concerns can be ameliorated through the use of appropriate adapter modules 408.

Figure 6D:
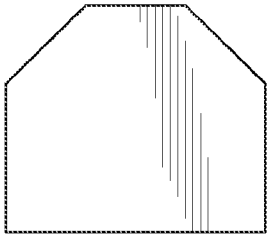
Figure 6E:
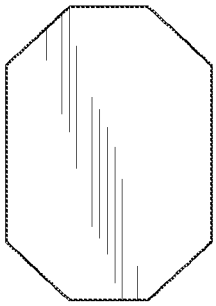

FIG. 6D depicts an opening that may be beneficial if the preferred grip changes for different exercises. For example, an octagonal opening may be useful when swinging the exercise apparatus 100. However, a flat edge may be desirable when using the exercise apparatus with a curling or bench press like motion. By altering their shape and orientation, openings can be designed to accommodate varying grip requirements and exercise regiments.

Figure 6F:
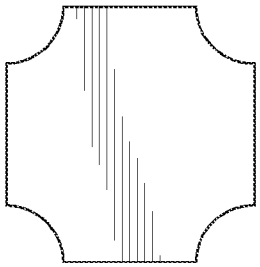
Figure 6G:
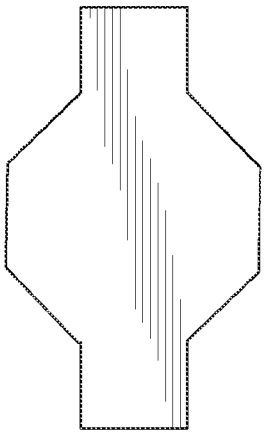

FIG. 6F depicts a convex octagonal opening with two opposing sides longer than the other. If the opening is intended for an exerciser to stand across, this embodiment provides a wider opening to increase the range of applicable foot widths. However, this configuration would still provide many of the benefits of having a regular octagonal opening.

In an alternate embodiment, opening 103 might have a lantern shape like the one shown in FIG. 6H. In this embodiment, the opening generally has a convex regular octagonal shape. However, it also has two cut-outs along two opposing sides. In this embodiment, convex regular octagonal modules such as the ones illustrated in FIGS. 5A-5I could be employed. If this "lantern" opening were placed on arcuate surface 101 and properly oriented, the cut-outs might have a lower elevation than other portions of the opening. This would allow for the placement of a bar or other object across the exercise apparatus 100 while still allowing for the placement of a module 300 above.

Figure 7:
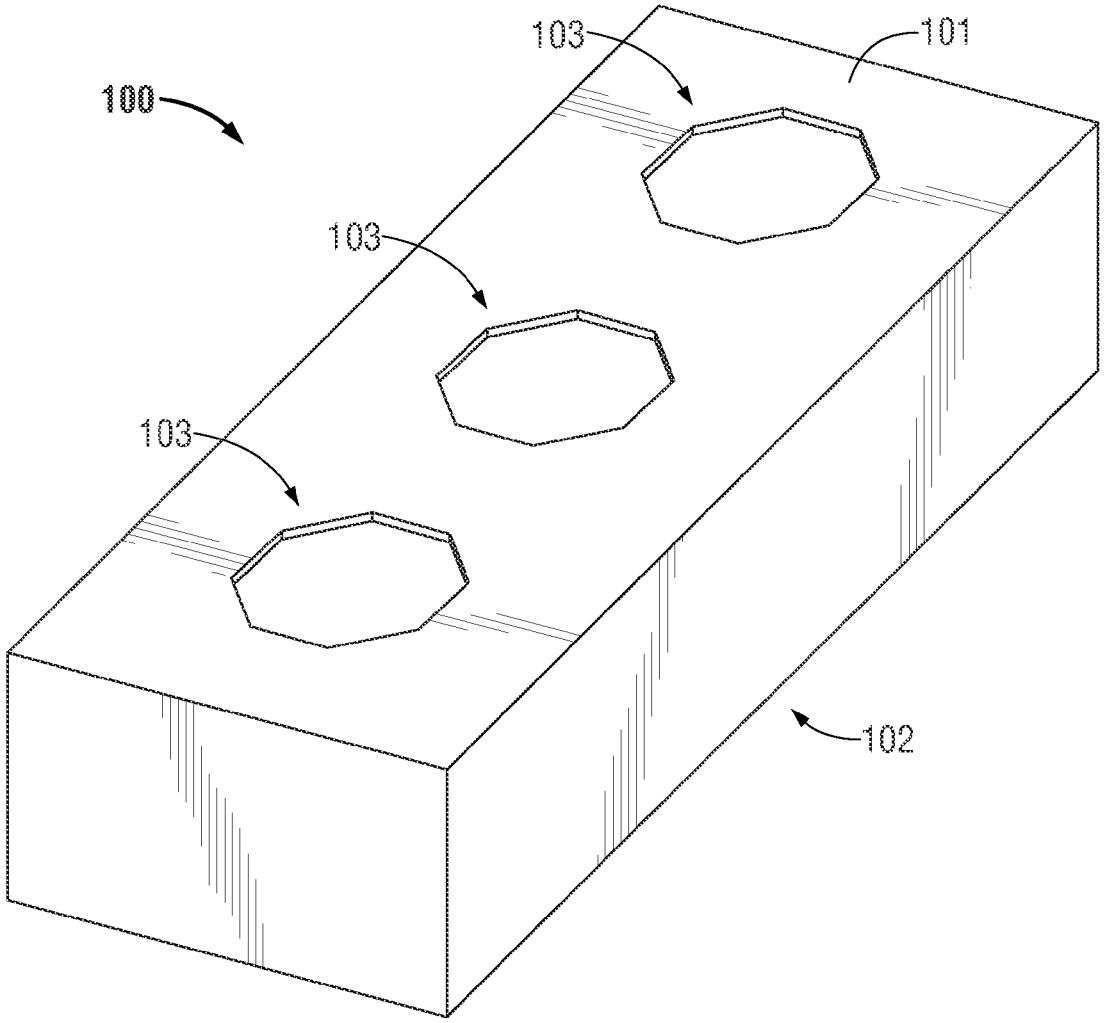
FIG. 7 depicts an alternative prismatic exercise apparatus having a planar upper side and a planar lower side.

FIG. 7 depicts an alternative embodiment of exercise apparatus 100 configured as shown with surfaces 101 and 102 and shown with plural polygonal openings 103 through surface 101. Apparatus 100 in this embodiment is a rectangular prism. This provides a stable surface to push against but does not provide the arcuate surface 101 of the embodiment shown in FIG. 1 which can be useful in particular in developing balance skills.

Although the present invention and its advantages have been described in detail, it should be understood that various changes, substitutions and alterations can be made to the embodiments described herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention.

The invention claimed is:

1. An exercise system comprising:

a hollow cylindrical structure having a first side and a second side, the first side having plural polygonal openings; and a module having plural sides of uniform size configured to form the module into a regular polygonal prism and one or more of the plural sides contains an attachment mechanism configured to attach the module to one of the plural polygonal openings of the cylindrical structure.

2. The system of claim 1 in which the module has a polygonal face attached to the polygonal prism.

3. The system of claim 1 in which each of the plural sides of the module contains an attachment mechanism.

4. The system of claim 1 in which the attachment mechanism of the module comprises one or more spring plungers.

5. The system of claim 2 in which a bubble level is disposed within said face of the module.

6. The apparatus of claim 1 in which a loop is attached to the module.

7. The apparatus of claim 6 in which the loop is elastic.

8. The apparatus of claim 2 further comprising:

a ball roller disposed within an outer surface of said face of the module.

9. The apparatus of claim 2 further comprising:

a cavity in said face of the module configured for receipt of a mobile media device; and one or more attachment devices to hold a mobile media device within said cavity.

10. The apparatus of claim 9 in which the mobile media device is a mobile phone.

11. The apparatus of claim 1 further comprising:

a polygonal face attached to first and second open ends of the polygonal prism of the module, at least one of said open ends comprising a closable opening.

* * * * *